US006091831A

United States Patent [19]

Cho

[11] Patent Number: 6,091,831

[45] Date of Patent: Jul. 18, 2000

[54] ELECTRONIC PRODUCT WITH A FUNCTION KNOB CAPABLE OF RECEIVING VOICE SIGNAL

[75] Inventor: Nam-Ill Cho, Suwon-si, Rep. of Korea

[73] Assignee: SamSung Electronics Co., Ltd., Suwon, Rep. of Korea

[21] Appl. No.: 08/888,644

[22] Filed: Jul. 7, 1997

[30] Foreign Application Priority Data

Jul. 5, 1996 [KR] Rep. of Korea ..... 96-27267

[51] Int. Cl.[7] ..... H04R 25/00

[52] U.S. Cl. ..... 381/365; 381/306; 200/7; 345/184

[58] Field of Search ..... 381/306, 333, 381/365, 110; 200/7, 566; 345/184; H04N 5/640

[56] References Cited

U.S. PATENT DOCUMENTS 2,515,031 7/1950 Black, Jr. .
3,870,820 3/1975 Suzuki et al. .
5,180,050 1/1993 Rada et al. .
5,400,408 3/1995 Lundgren et al. .
5,627,901 5/1997 Josephson et al. .
5,870,485 2/1999 Lundgren et al. .

*Primary Examiner*—Curtis A. Kuntz
*Assistant Examiner*—Phylesha Dabney
*Attorney, Agent, or Firm*—Robert E. Bushnell, Esq.

[57] ABSTRACT

An electronic product has a function knob capable of receiving voice signals. The electronic product includes a case forming the product's external appearance and is provided with the function knob for performing a given function of the product. A microphone is installed in the function knob to operate a given function and receive the voice signals. The function knob has a dustproof rubber member to shield the overall surface of the microphone other than the front side of the function knob from dusts and noises. The function knob, with the microphone installed therein, can be a button operated by a press or a dial by a rotation, thereby allowing the microphone to be highly sensitive to the voice signals but not spoiling the external appearance of the product.

17 Claims, 7 Drawing Sheets

ELECTRONIC PRODUCT WITH A FUNCTION KNOB CAPABLE OF RECEIVING VOICE SIGNAL

CLAIM OF PRIORITY

This application makes reference to, incorporates the same herein, and claims all benefits accruing under 35 U.S.C. §119 from an application entitled *Electronic Product with a Function Knob Capable of Receiving Voice Signal* earlier filed in the Korean Industrial Property Office on Jul. 5, 1996, and there duly assigned Ser. No. 96-27267 by that Office.

BACKGROUND OF THE INVENTION

1. Field of the Invention

The present invention relates to an electronic product with a function knob, such that the electronic product is capable of receiving voice signals. More particularly, the present invention relates to an electronic product having a function knob such as button or dial and employing a microphone.

2. Discussion of Related Art

Often, an electronic product, e.g. an electronic display apparatus, is a multitype electronic product; for example, the electronic product may be capable of receiving signals from the main body of a computer to display characters or images on a monitor, yet is also capable of processing voice signals. Such a multitype electronic product may employ a microphone to process voice signals, usually a condenser type microphone that is relatively small in diameter. It is noted that the condenser microphone must be screened against noises caused by a resonance effect in the electronic product because the microphone may be so constructed to catch the faintest of sounds. An hauling effect (due to noise intervening the microphone) results in a deterioration of the product's reliability. Thus, multitype sound products must overcome this and other technical barriers. On this matter of the art of multitype sound products, an exemplar of the contemporary art, Conley et al. (U.S. Pat. No. 5,638,456, *Piezo Speaker And Installation Method For Laptop Personal Computer And Other Multimedia Applications,* Jun. 10, 1997) discusses placing piezoelectric patches behind the LCD and directly to the back wall of the laptop lid. Wang (U.S. Pat. No. 5,631,449, *Audio Transmission Device For Mounting In A Monitor Of A Computer System,* May 20, 1997) discusses an audio transmission device for mounting in a monitor of a computer system and including a pair of symmetric frameworks. Anderson (U.S. Pat. No. 5,493,079, *Vocal Communication Snorkel,* Feb. 20, 1997) discusses a vocal communication snorkel including a hollow body having a breather tube and diaphragms of thin plastic material that are tuned to resonance within the frequency band of 1500 to 3000 Hertz in water. Kato et al. (U.S. Pat. No. 4,993,510, *Mobile Speaker Fixing Device,* Feb. 19, 1991) discusses a speaker grille arranged to have screw seats projected toward a mount opening in a rear parcel tray. Carter et al. (U.S. Pat. No. 4,805,728, *Sound System With Anechoic Enclosure,* Feb. 21, 1989) discusses a sound source outputting a first sound signal which is amplified and fed to a speaker in an anechoic enclosure. A microphone in the anechoic chamber outputs a second sound signal which is amplified and distributed to room speakers. DeRocher (U.S. Pat. No. 4,633,972, *Speaker Retainer,* Jan. 6, 1987) discusses a speaker retainer for mounting a speaker to a vehicle body panel. Ebach (U.S. Pat. No. 4,226,162, *Attachment For Musical Wind Operated Instruments,* Oct. 7, 1980) discusses a hollow cylindrical member attachable to the end of a musical wind operated instrument. From my study of the contemporary art and practice, I find that there is a need for an improved and effective electronic product with a function knob capable of receiving voice signals, especially in computer monitors with control dials.

SUMMARY OF THE INVENTION

Thus, an object of the present invention is to provide an effective electronic product with a function knob capable of receiving voice signals.

Another object of the present invention is to provide an electronic product with a function knob such as button or dial employing a microphone, thereby allowing the product to fulfill a double function and also enhancing the design and the beauty of the product.

Another object of the present invention is to provide an electronic product that has a microphone for receiving voice signals in a most agreeable position, so as to permit the microphone to be highly sensitive to the voice signals but not spoil the external appearance of the product.

To achieve these and other objects, an electronic product has a function knob capable of receiving voice signals. The product includes a case forming the product's external appearance and is provided with the function knob for performing a given function of the product. A microphone is installed in the function knob to operate a given function and to receive the voice signals. The function knob has a dustproof rubber member to shield the overall surface of the microphone other than the front side of the function knob from dust and noises. The front side of the function knob has a voice reception aperture (which is an auxiliary mechanism) close to the microphone to receive the voice signals. The microphone is coupled to an operational bar for operating a knob functioning section and to the end of the function knob.

BRIEF DESCRIPTION OF THE ATTACHED DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENT

Reference will now be made in detail to the preferred embodiments of the present invention, examples of which are illustrated in the accompanying drawings.

Some technical challenges exist in invention of a microphone that is in conjunction with such a sensitive electronic product. To prevent the microphone from trembling by the vibration or sound wave of such a sensitive electronic product, the microphone is shielded by a dustproof rubber member for absorbing a sound. The microphone is usually installed in a case positioned on the top or on one lateral side of the electronic product so that it can be protected against an external sound. The case is provided with a voice reception aperture through which an external sound wave passes the case. The voice reception aperture is round or square-shaped, and relatively small in size but visible to ordinary sight. Such an aperture formed on the front surface of the product's front case make the product appear to be a defective in the aspect of an external appearance. Forming the microphone and voice reception aperture on the lateral sides of the case may solve the problem in the deterioration of the product's design but result in the reduction of sensitivity to the voice signals. The microphone to receive voice signals properly provided on the front side of the product may injure the external appearance due to the voice reception aperture. FIGS. 1 through 7 illustrate some of the solutions to these problems and challenges.

Figure 1:
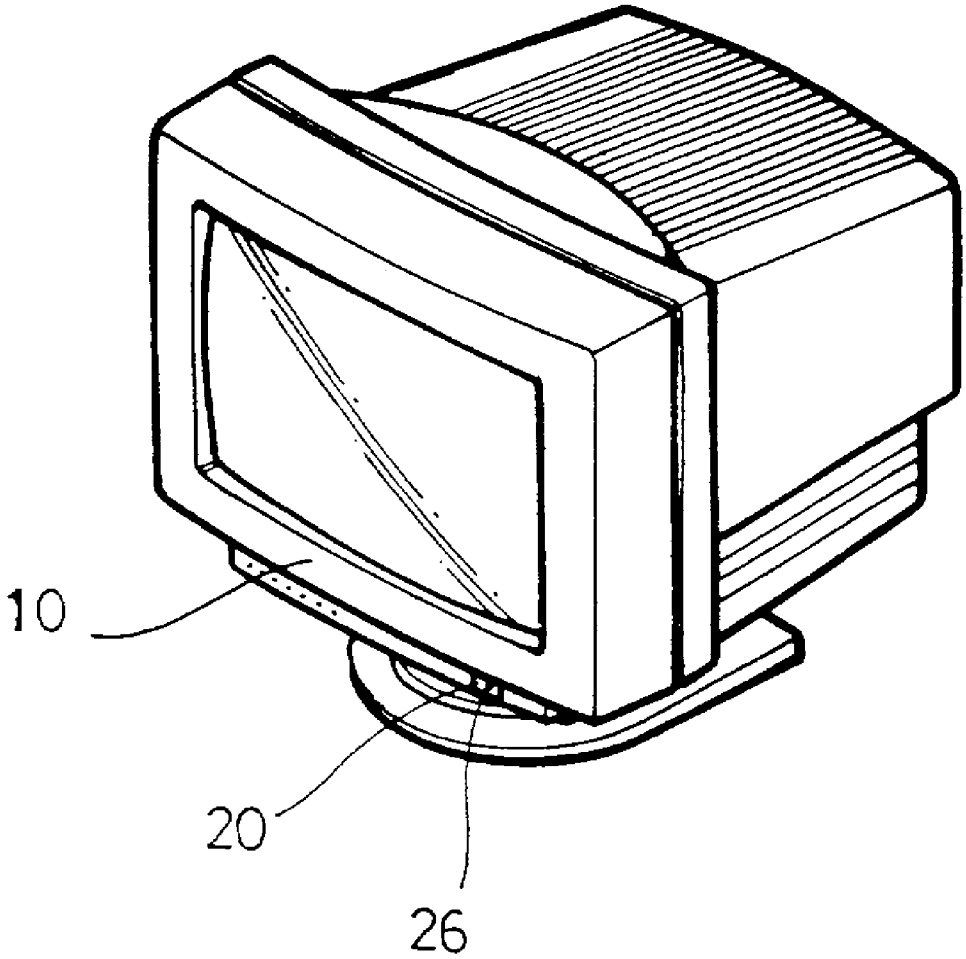
FIG. 1 is a perspective view of a display device built in accordance with the principles of the present invention.

FIG. 1 shows an electronic product having a function knob capable of receiving voice signals in accordance with a first preferred embodiment of the present invention. A display device of FIG. 1 has a power button (hereinafter, referred to as 'button') 20 under a front case 10 thereof.

Figure 2:
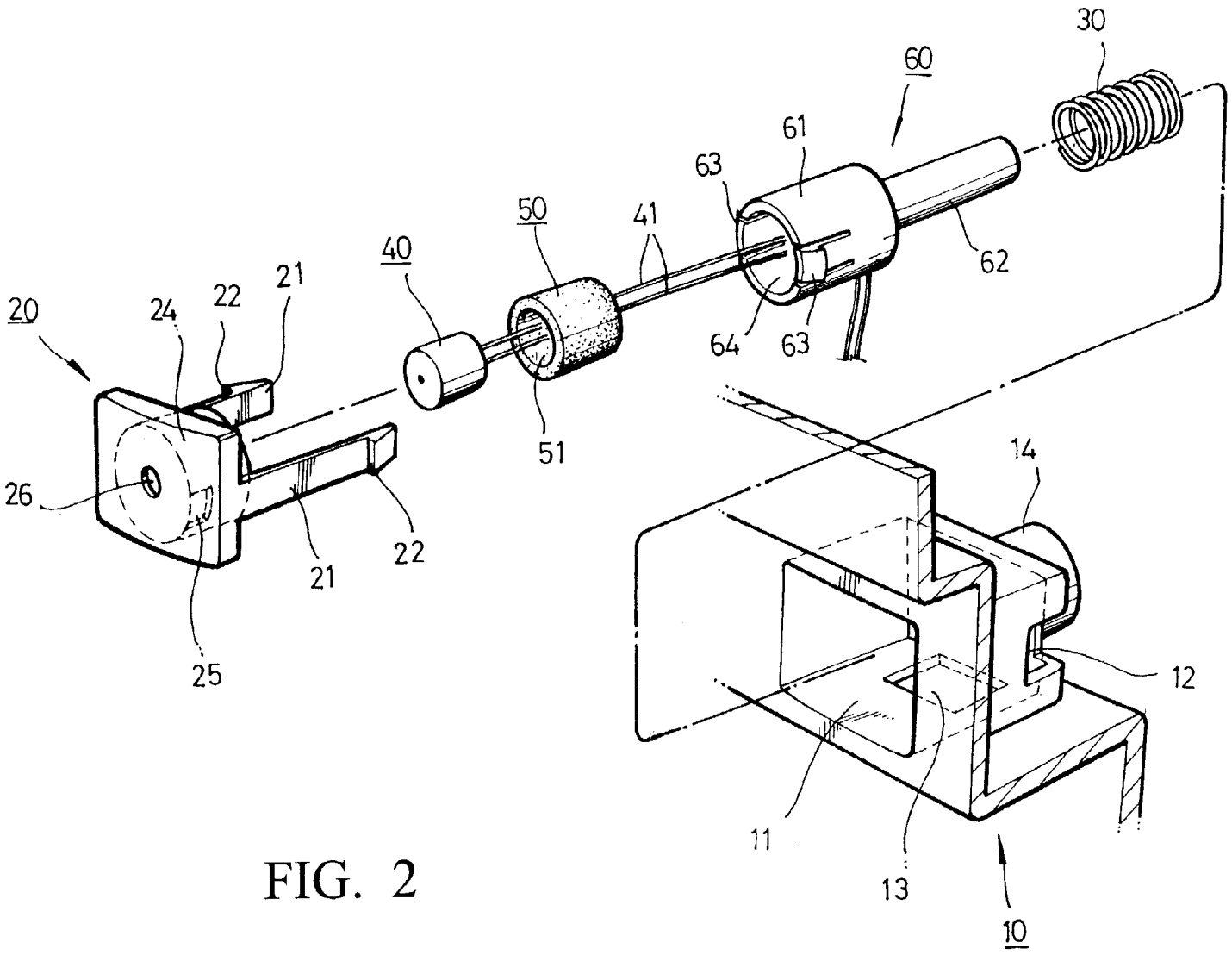
FIG. 2 is an exploded perspective view illustrating a first preferred embodiment of the present invention.

FIG. 2 gives more details on the button 20. As shown in FIG. 2, this button 20 can be pressed and returned to the original condition with the elastic force of a spring 30. The button 20 includes long guide snap pieces 21 (alternatively called tines) on both lateral sides. Each of the guide snap pieces 21 has a flange 22 at the end portion thereof. When pressing the button, the guide snap pieces 21 allow the button 20 to move straight. The flanges 22 (alternatively called detents) of the guide snap pieces 21 are caught in stop end portions 12 that are positioned on both lateral sides of a button hole 11 formed in a front case 10. The button 20 cannot get out of the button hole 11 when the elastic force of the spring 30 moves the button 20 in the external direction. Thus, the guide snap pieces 21 are not limited in their position on both lateral sides of the button 20; they can be formed vertically on the button 20.

Microphone 40 can be inserted using this button 20. Back side of the button is provided with a fitting tube 24 having an insertion groove 23 that allows the microphone 40 to be inserted. Snap holes 25 are formed in the fitting tube 24 inside of the insertion groove 23. The insertion groove 23 is preferably deep enough for the microphone 40 to be inserted thereinto and fittingly sized in diameter to the coupling piece 61 of an operational bar 60 (which will be described later). A voice reception aperture 26 is formed in the front side of the button 20 having a diameter one twentieth as large as that of the front side, which permits the button 20 to be pressed smoothly. The voice reception aperture 26 may be visible to an ordinary sight: yet, this does not mar the external appearance because it can be pierced by the button 20.

The microphone 40 has a microphone cable 41 connected to a circuit board 70 and piercing through a dustproof rubber member 50 (alternatively called a sleeve). The microphone 40 is a small-sized condenser microphone commonly used in the electronic products. The dustproof rubber member 50 is round-shaped and made of an elastic rubber material, having a coupling hole 51 for the microphone 40 to be tightly inserted thereinto.

The operational bar 60 (which is to install the microphone 40) has the coupling piece 61 inserted into the insertion groove 23 of the button 20 and united with a long operational boss 62 at the end thereof. The coupling piece 61 is so small in diameter as to be tightly inserted into the insertion groove 23 of the button 20 and united with elastic snap flanges 63 (alternatively called detents) on the outer surface thereof. The snap flanges 63 are caught in the snap fastening holes 25 formed inside of the insertion groove 23, thereby coupling the operational bar 60 to the button 20. The present invention has at least two, most preferably, three or so snap holes 25 and snap flanges 63 according to the size of the components of the button 20 for the purpose of a stable and balanced coupling between the operational bar 60 and button 20.

There is another way. Instead of the snap holes 25 and snap flanges 63, the operational bar 50 can be coupled to the button 20 by means of a screw or an additive. In an aspect of rapid assemblage and easy detachment of the microphone 40, it is desirable to have the snap holes 25 and snap flanges 63.

The operational bar 60 has a cable hole 65 inside of the insertion groove 64 of the coupling piece 61 that is fitted to the dustproof rubber member 50 tightly inserted thereinto. The switch boss 62 of the operational bar 60 has the spring 30 to give an elastic force externally to the operational bar 60 and button 20.

The front case 10 has the button hole 11 into which the button 20 is inserted to make a forward and backward motion. The flanges 22 of the guide snap pieces 21 are caught in the stop end portions 12 formed on both lateral sides of the button hole 11 formed in a front case 10. The button hole 11 has a cable through hole 13 for the microphone cable 41 to pass through the inside bottom of the button hole 11. The end of the button hole 11 has the guide tube 14 pierced by the switch boss 62 of the operational bar 60. The control circuit board 70 connected to the microphone cable is supported by a guide 71 in the end of the button hole 11 and has a tact switch 80 that is pressed by the switch boss 62 of the operational bar 60.

Figure 3:
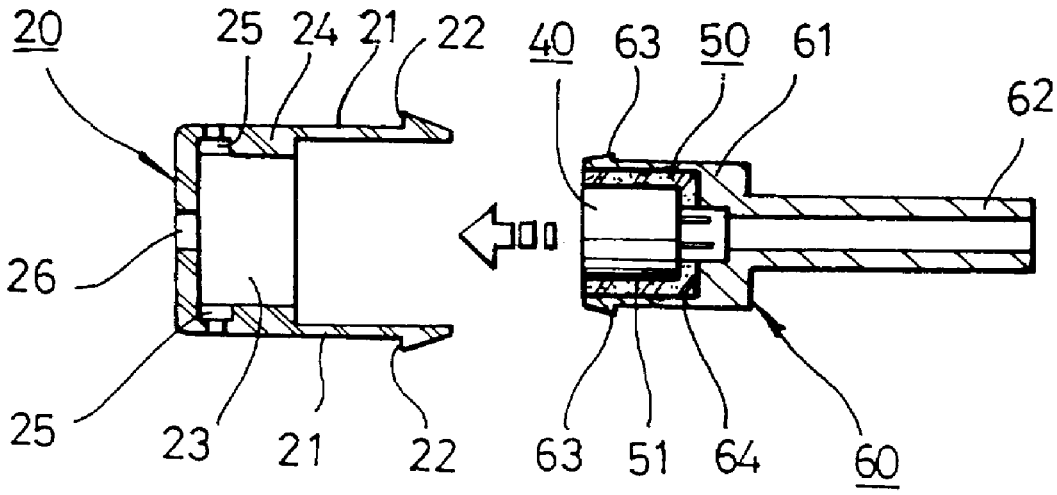
FIG. 3 is an exploded sectional view illustrating first and second assemblages of the first preferred embodiment of the present invention.
Figure 4:
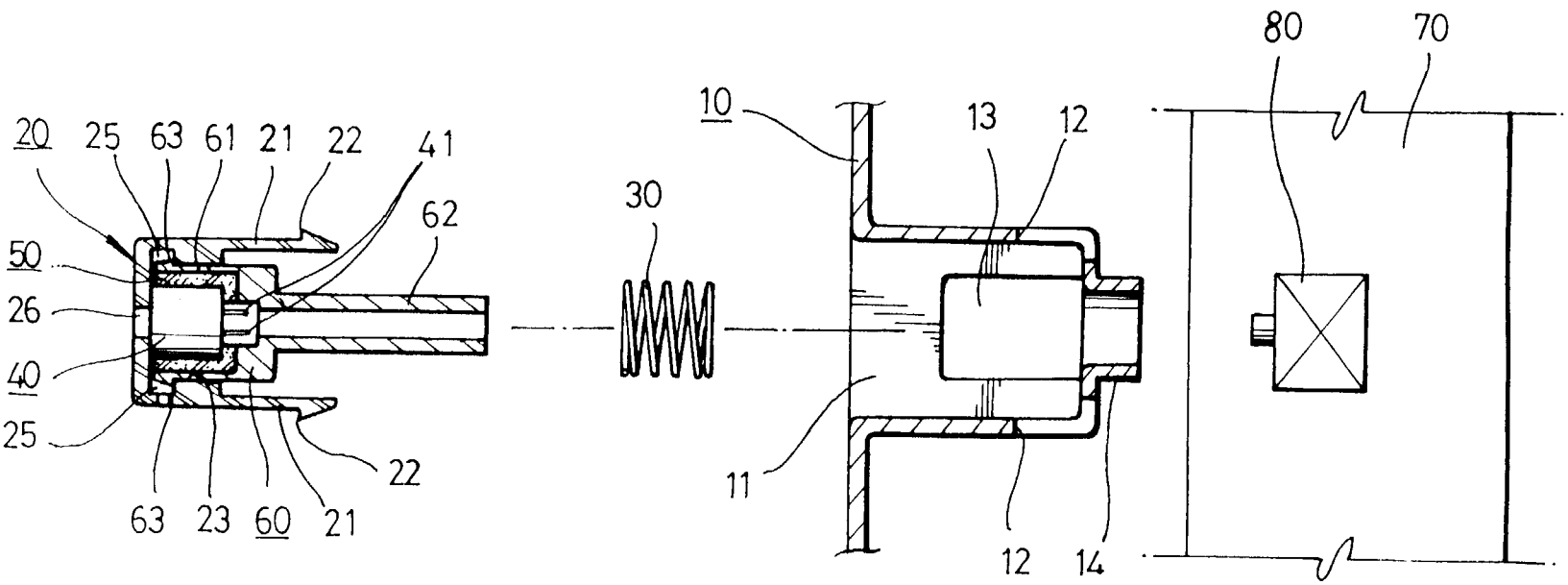
FIG. 4 is an exploded sectional view illustrating a third assemblage of the first preferred embodiment of the present invention.

The assemblage and operation of the first embodiment of the present invention is described with reference to FIGS. 3, 4 and 5.

In a first assemblage, the microphone 40 is coupled to the dustproof rubber member 50 and operational bar 60. Referring to FIG. 3, the microphone 40 is first inserted tightly into the coupling hole 51 of the dustproof rubber member 50. The dustproof rubber member 50 coupled to the microphone 40 is inserted fittingly into the insertion groove 64 formed in the coupling piece 61 of the operational bar 60. At the time, the microphone cable 41 pierces through the cable hole 65 of the dustproof rubber member 50 and operational bar 60. Thus the microphone 40 is compressibly coupled to the dustproof rubber member 50 in the insertion groove 64 of the operational bar 60.

The operational bar 60 having the microphone 40 is coupled to the button 20 in a secondary assemblage. As shown in FIG. 3, the snap flanges 63 of the coupling piece 61 are inserted into and caught in the snap holes 25 of the insertion groove 23. In the process, the insertion groove 23 receives the snap flanges 63 pressed inward and the snap flanges 63 are elastically caught in the snap holes 25. The snap flanges 63 are pressed inward, which can be available due to the elasticity of the dustproof rubber member 50.

In a third assemblage, the button 20 having the microphone 40, dustproof rubber member 50 and operational bar 60 is coupled to the button hole 11 of the front case 10. Referring to FIG. 4, the snap pieces 21 of the button 20 are inserted into the button hole 11. The spring 30 is fitted to the switch boss 62 of the operational bar 60 so as for the switch boss 62 to pierce through the guide tube 14.

Figure 5:
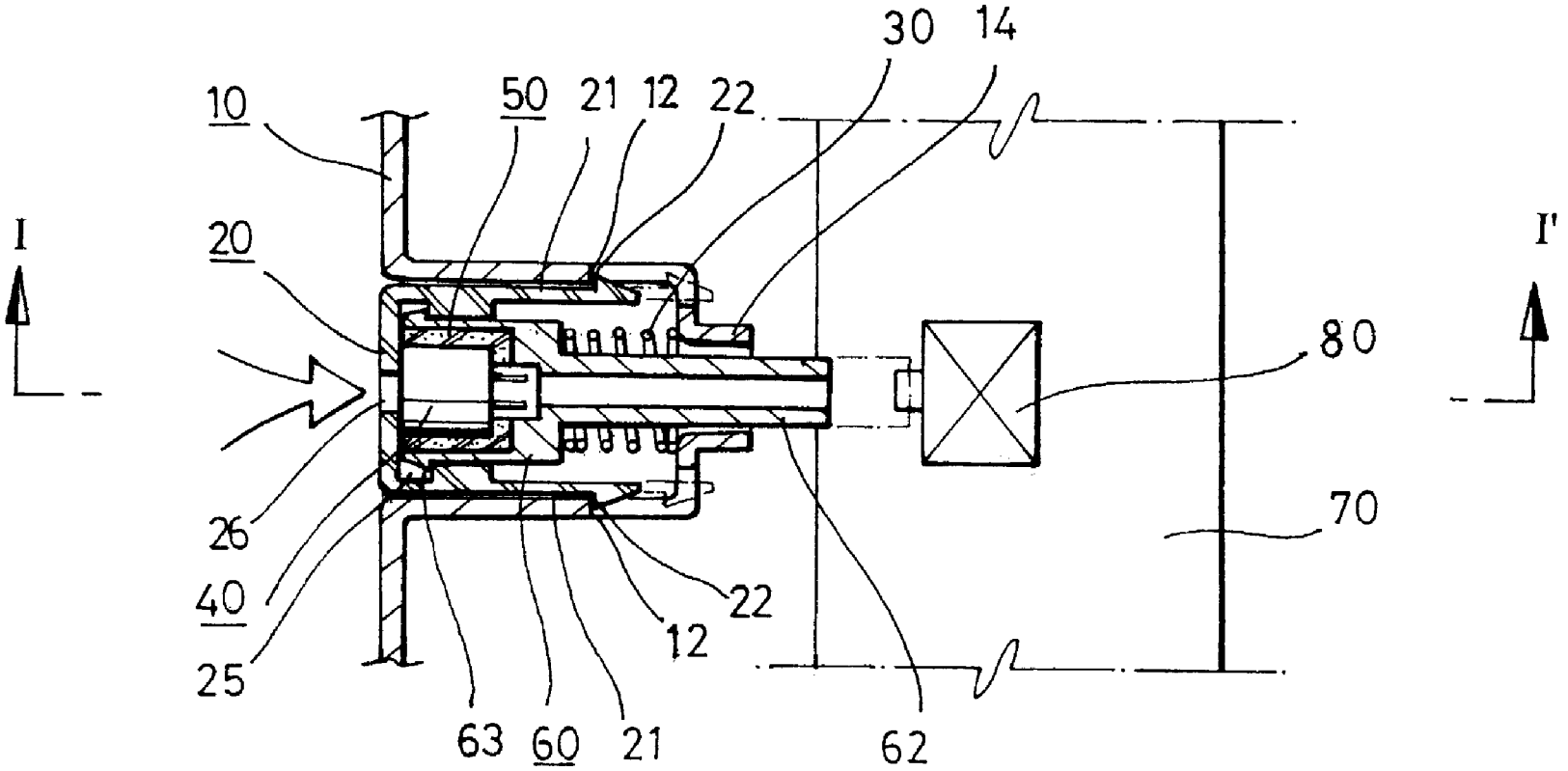
FIG. 5 is a sectional view illustrating an operation of the first preferred embodiment of the present invention.
Figure 6:
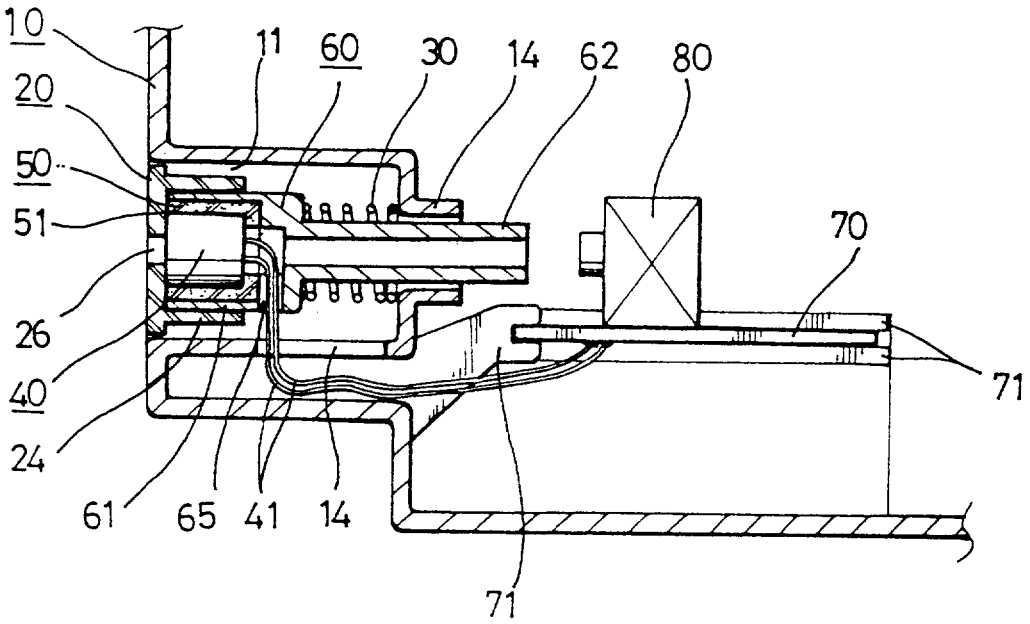
FIG. 6 is a cross-sectional view taken on line A-A' in FIG. 5.

FIG. 5 gives a sectional view. Referring to FIG. 5, the flanges 22 of the snap pieces 21 of the button 20 are caught in the stop end 12 of the button hole 11 so that the button 20 cannot be separated from the button hole 11 even with the elastic force of the spring 30. The operational bar 60 forms a stable support structure that the coupling piece 61 gives a support to the button 20 and the guide tube 14 supports the switch boss 62. The microphone 40 is closed to the voice reception aperture 26 of the button 20 to receive external voice signals. The microphone cable 41 pierces through the cable hole 65 of the operational bar 60 and the cable through hole 13 of the button hole 11 to receive voice signals transferred through the microphone cable 41 soldered to or connected by terminals to the circuit board 70. The microphone cable 41 is properly long enough to allow the button 20 to make a forward and backward motion.

As shown in FIG. 5, pressing the button 20 forces the operational bar 60 coupled to the end of the button 20 to make the switch boss 62 push the terminal of the tact switch 80 which operates in a known manner. Taking the finger off the button 20, the elastic force of the spring 30 gives a linear motion to the entire of the button 20 including the operational bar 60 and the flanges 22 of the snap pieces 21 are caught in the stop end portions 12. This interrupts the linear motion of the button 20 and holds the flanges tight.

The button 20 can have more than one use. The button 20 can be used, for example, as a power button for a monitor. Whenever the power is turned on or off, which is not a frequent operation, the button 20 is kept in a protrusion state. The dustproof rubber member 50 shields the microphone from noises caused by a resonance effect occurring in the monitor. Because the button 20 used as a power switch is usually positioned on the front side of the front case 10, the voice reception aperture 26 formed in the button 20 always faces the front. As a result, the microphone 40 is desirably positioned on the front side of the electronic product. The voice reception aperture 26 looks so natural and renders no limitation to the product's external design since it is formed in the button 20 that is a function knob installed on one lateral side of the case.

Figure 7:
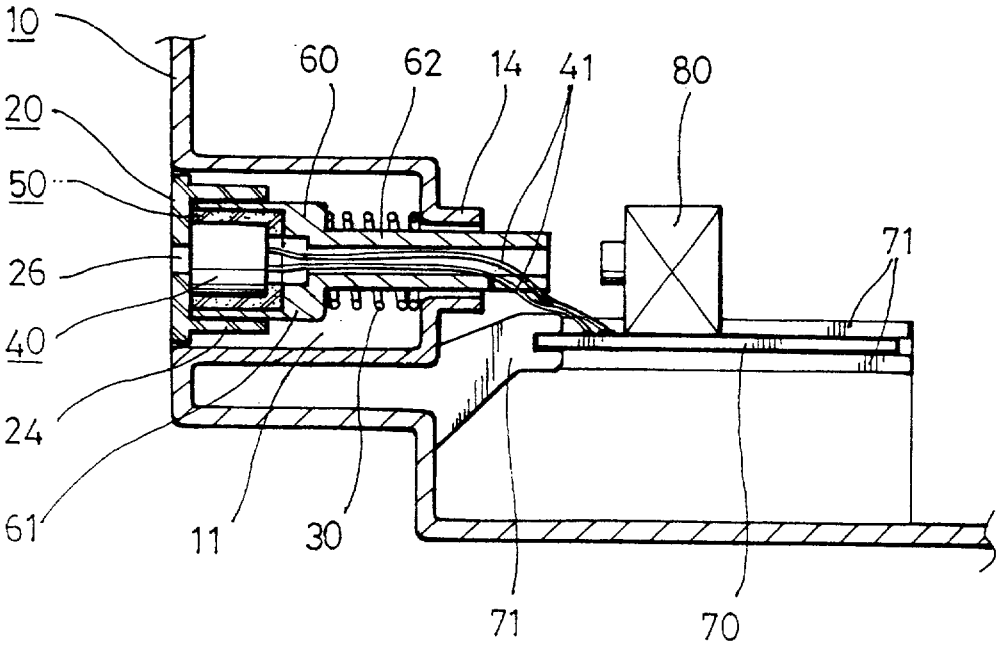
FIG. 7 is a vertical sectional view illustrating an another example of the first preferred embodiment of the present invention.

FIG. 7 shows another example of the first embodiment of the present invention. This concerns the wire work of the microphone cable 41. The microphone 40 has to be provided with the microphone cable 41 connected to the circuit board 70 without troubling the operation of the button 20. It requires to connect the microphone cable 40 from the microphone 40 to the circuit board 70 via the switch boss 62. Since the microphone cable 41 is drawn from the switch boss 62, the cable from the switch boss 62 to the circuit board 70 must be as short as possible.

Figure 8:
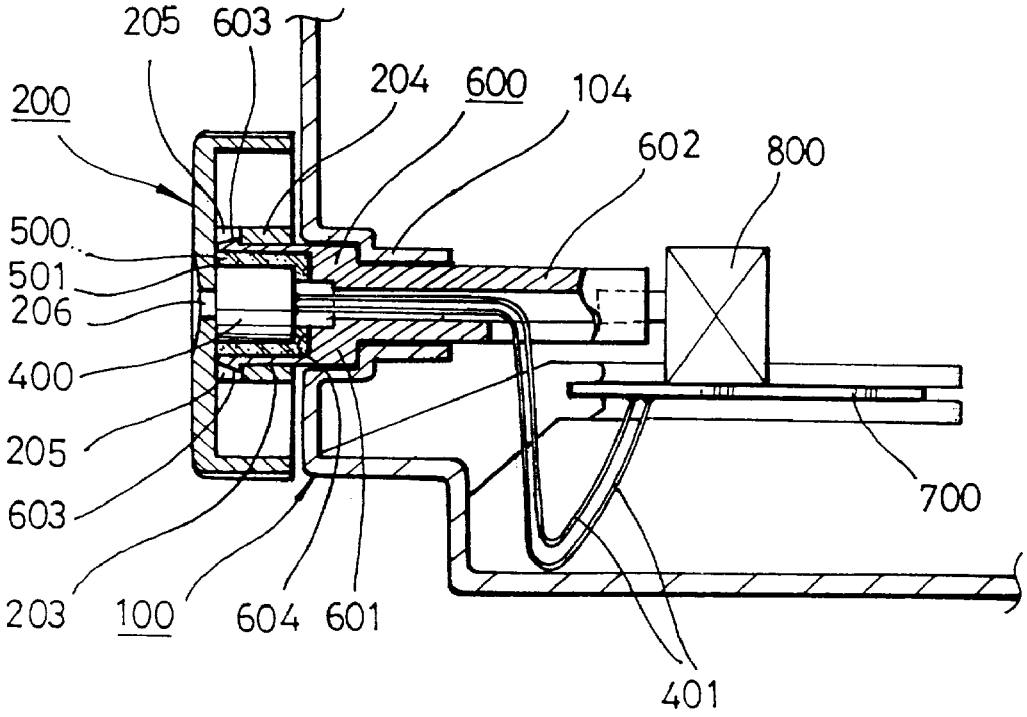
FIG. 8 is a vertical sectional view illustrating a second preferred embodiment of the present invention.

FIG. 8 gives an another embodiment. In the second preferred embodiment of the present invention as shown in FIG. 8, a microphone 400 is employed in a dial 200 that is one of the function knobs. The dial 200 is rotationally operated to give a rotation to an operational bar 600 inserted into a fitting tube 204. The operational bar 600 is provided with a coupling piece 601 having snap flanges 603 which is caught in snap holes 205 positioned in a guide groove 203 formed in the fitting tube 204. When the microphone 400 is tightly inserted into a coupling hole 501 of a dustproof rubber member 500, the coupling piece 601 of the operational bar 600 is coupled into an insertion groove 604. The microphone 400 has a microphone cable 401 piercing through a switch boss 602 of the operational bar 600 to have a coupling with a circuit board 700. The microphone cable 401 is long enough to wind the switch boss 602 in consideration of the rotation of the operational bar 600.

A front case 100 has a guide tube 104 in which the operational bar 600 of the dial 200 is rotationally supported. Since the switch boss 602 piercing through the guide tube 104 is directly connected to a rotary switch 800, the rotary switch 800 is operated by the rotation of the dial 200. The second embodiment is assembled in the same manner of the first embodiment to make the microphone 400 correspond to a voice reception aperture 206 formed in the center of the dial 200.

As described above, the present invention is designed to employ a function knob such as a button or dial for a microphone to receive the voice signals. This is so that the microphone and the function knob can provide multifunctions in such a multitype product. This microphone is positioned on the front side of the electronic product. Thus, the electronic product can attain a most effective reception of the voice signals. According to the present invention, the electronic product can receive the voice signals by means of the function knob that is essential for the product. This enhances the product's external appearance without any limitation from the voice reception aperture.

It will be apparent to those skilled in the art that various modifications and variations can be made in the electronic product with a function knob capable of receiving voice signals of the present invention without departing from the spirit or scope of the invention. Thus, it is intended that the present invention cover the modifications and variations of this invention provided they come within the scope of the appended claims and their equivalents.

What is claimed is:

1. An electronic display monitor apparatus having a display monitor, the electronic apparatus performing a predetermined electronic function using free electrons to enable the display monitor to display images, the electronic apparatus comprising:

a housing covering an interior of the electronic apparatus, said housing providing an exterior form of the electronic apparatus;

the display monitor to display the images sent from a computer connected to the electronic apparatus;

a function knob attached to said housing, said function knob having a dial being turnable in a rotary direction, said function knob for performing the electronic predetermined function of the electronic apparatus in dependence upon turns of said function knob in the rotary direction; and a microphone installed in said function knob, said microphone being positioned to receive voice signals before the voice signals are stored by the electronic apparatus into a memory.

2. The apparatus of claim 1, wherein said function knob comprises a dustproof rubber member covering a surface of said microphone, said dustproof rubber member shielding said microphone from dust and noise.

3. The apparatus of claim 1, further comprising said function knob having a button being operatable when pressed by a user, said function knob performing said electronic predetermined function of the electronic apparatus when said button is pressed by the user.

4. An electronic apparatus, comprising:

a visual display apparatus illustrating varying visual images in response to applied signals;

a housing providing an exterior form for said electronic apparatus, said housing being perforated by a first closed aperture exposing said visual display apparatus to exhibit said visual images and a second closed aperture that is spaced-apart and separate from said first aperture;

a manually movable member perforated by a third closed aperture, said movable member being movably received within said second aperture to control performance of an electronic predetermined function by said electronic apparatus;

a microphone installed within said movable member to receive audio sounds via said third aperture; and a dustproof resilient member installed between said movable member and an exterior surface of said microphone.

5. The apparatus of claim 4, further comprised of said movable member comprising a button being operable upon manipulation by a user to reciprocate relative to said second aperture and control said electronic predetermined function of the electronic apparatus in response to said manipulation by the user.

6. The apparatus of claim 4, with said function knob comprising a dial operated by manual rotation.

7. The apparatus of claim 4, with said said movable member comprising:

a switch located within said housing; and an operational bar having a first end encasing said microphone while exposing said microphone to said audio sounds via said third aperture, an intermediate section received within said second aperture, and a second end separated by said intermediate section from said first end operatively coupled to.

8. A display device, comprising:

a display device illustrating varying visual images;

a housing encasing said display device while providing a first aperture exposing said visual images to view, said housing being perforated by a second aperture spaced-apart from said first aperture;

a microphone converting audio sounds into audio signals;

a movable member supporting said microphone, said movable member being perforated by a third aperture exposing said microphone to said audio sounds and an intermediate section received within said second aperture while a first end of said movable member is exposed by said housing to manual manipulation;

a switch located inside said housing; and said movable member comprising a bar extending through said second aperture and operationally engaging said switch under influence of said manual manipulation.

9. The display device of claim 8, with said movable member operating said switch while rotating relative to said housing under said influence of said manual manipulation.

10. The display device of claim 8, with said movable member operating said switch while reciprocating relative to said housing under said influence of said manual manipulation.

11. A method, comprising the steps of:

creating a housing to encase a video monitor while exposing a screen of the monitor and forming in a front portion of the housing a sidewall around a first aperture in said housing;

forming a second aperture in a front side of a button;

slidably fastening said button to said sidewall with said button remaining movably positionable by manual manipulation within said first aperture to control a predetermined electronic function operationally affecting the monitor;

forming a hollow elongated tube on a back side of said button;

covering an exterior surface of a microphone with a sleeve made of a resilient material;

covering said sleeve with a hollow elongated coupling;

slidably fastening said coupling inside said tube; and manipulating a switch with a boss extending from said coupling.

12. The method of claim 11, wherein said button is operatable upon manipulation by a user to reciprocate relative to said first aperture and control said predetermined function of said monitor in response to said manipulation by the user.

13. The method of claim 11, wherein said button operates said switch while rotating relative to said housing under said influence of said manual manipulation.

14. An electronic apparatus, comprising:

a visual display apparatus illustrating varying visual images;

a housing providing an exterior form for said electronic apparatus, said housing being perforated by a first closed aperture exposing said visual display apparatus to exhibit said visual images and a second closed aperture that is spaced apart from said first aperture, said housing being molded inwardly and forming a chamber having a sidewall around the second aperture, said chamber having a pair of first holes, said monitor housing having a tube formed at an end portion of the chamber;

a button slidably installed into said chamber of said monitor housing, said button having a third aperture on a front side of said button, said button forming an elongated hollow on a back side of said button, said button having a pair of tines terminating with a detent at an end portion of each said pair of tines, said button having a pair of second holes, said button being movably positionable within said chamber to control by manual manipulation a predetermined electronic function of said apparatus;

a microphone installed in said cylindrical hollow on the back side of said button;

a sleeve of a resilient material covering said microphone;

an elongated member having a first end portion and a second end portion, said first end portion having a first bore coupling said microphone covered by said sleeve, said second end portion having a second bore, the first bore having a circumference greater than the second bore, said elongated member having a pair of detents at said first end portion;

a boss extending from said second portion of said elongated member, said boss being hollow with a circumference less than a circumference of said cylindrical member;

a switch located inside said housing and being operationally engaged by said boss under influence of said manual manipulation;

a circuit board connected to a bottom side of said switch;

a guide supporting said circuit board, said guide being connected to said circuit board and said monitor housing; and a microphone cable extending from said microphone to said circuit board.

15. The electronic apparatus of claim 14, further comprising a spring encompassing said boss, said spring touching said cylindrical member and said chamber.

16. The electronic apparatus of claim 14, wherein said microphone cable is extending from said microphone through a third hole of said first portion of said cylindrical member and through a fourth hole of said chamber, connecting to said circuit board.

17. The electronic apparatus of claim 14, wherein said microphone cable extending from said microphone through a hollow portion of said boss, connecting to said circuit board.

* * * * *